US006449903B1

(12) United States Patent
Borcherding

(10) Patent No.: US 6,449,903 B1
(45) Date of Patent: Sep. 17, 2002

(54) SNAP-TOGETHER SHUTTERS WITH MOVEABLE LOUVERS

(76) Inventor: Norb Borcherding, Double L Group Ltd, P.O. Box 324, Dyersville, IA (US) 52040

( * ) Notice: Subject to any disclaimer, the term of this patent is extended or adjusted under 35 U.S.C. 154(b) by 0 days.

(21) Appl. No.: 09/474,888

(22) Filed: Dec. 29, 1999

(51) Int. Cl.[7] ..... E06B 7/08; E06B 7/10
(52) U.S. Cl. ..... 49/74.1; 49/73.1; 49/504
(58) Field of Search ..... 49/73.1, 74.1, 49/87.1, 504, 371, 77.1; 403/169, 170, 180, 182, 217; 160/236

(56) References Cited

U.S. PATENT DOCUMENTS

| | | | | | |
|---|---|---|---|---|---|
| 468,703 | A | * | 2/1892 | Smith | 49/77.1 |
| 2,225,885 | A | * | 12/1940 | Penman | 454/349 |
| 2,544,182 | A | | 3/1951 | Roberts | |
| 2,738,040 | A | * | 3/1956 | Waldin | 49/74.1 |
| 3,031,013 | A | * | 4/1962 | Russell | 49/403 |
| 3,055,467 | A | | 9/1962 | Peek et al. | |
| 3,292,309 | A | * | 12/1966 | Horner | 49/64 |
| 4,089,257 | A | | 5/1978 | Dunne | |
| 4,161,375 | A | * | 7/1979 | Murphy | 403/169 |
| 4,205,486 | A | * | 6/1980 | Guaracci | 49/501 |
| 4,251,966 | A | | 2/1981 | Foltman | |
| 4,254,581 | A | * | 3/1981 | Ishihara | 49/82.1 |
| 4,393,629 | A | | 7/1983 | Gasparini et al. | |
| 4,996,793 | A | * | 3/1991 | Mazur | 49/74.1 |
| 5,001,864 | A | * | 3/1991 | Truscott | 49/403 |
| 5,105,581 | A | * | 4/1992 | Slocomb | 49/504 |
| 5,148,649 | A | * | 9/1992 | Cipriano | 52/656.5 |
| 5,191,735 | A | * | 3/1993 | Ross | 49/74.1 |
| 5,342,187 | A | * | 8/1994 | Ohanesian | 425/70 |
| 5,377,738 | A | * | 1/1995 | Cooper | 160/133 |
| 5,379,551 | A | * | 1/1995 | Swapp | 49/82.1 |
| 5,490,353 | A | * | 2/1996 | McLaughlin | 49/64 |
| 5,673,526 | A | | 10/1997 | Schiedegger et al. | |
| 5,755,069 | A | | 5/1998 | Sullivan | |
| 5,775,399 | A | * | 7/1998 | Shields | 160/176.1 |
| 5,924,255 | A | | 7/1999 | Vagedes | |
| 6,021,838 | A | * | 2/2000 | Taffe | 160/172 |
| 6,119,416 | A | * | 9/2000 | Larson | 52/212 |

FOREIGN PATENT DOCUMENTS

| | | | | |
|---|---|---|---|---|
| DE | 815591 | * | 10/1951 | 403/218 |
| FR | 1200494 | * | 12/1959 | 403/217 |
| NL | 7514983 | * | 6/1977 | 49/504 |

* cited by examiner

*Primary Examiner*—Gregory J. Strimbu
(74) *Attorney, Agent, or Firm*—James C. Nemmers

(57) ABSTRACT

A snap-together shutter in which moveable louvers are mounted within a snap-together frame to allow for the convenient assembly of the shutter with or without the use of tools. The frame is comprised of frame members that are joined using corner pieces and T-pieces. For larger shutters, interior center bars may be used in combination with the frame members to support the moveable louvers. A series of flexible pivot rods are mounted within the frame, and the louvers are mounted on the flexible pivot rods.

4 Claims, 5 Drawing Sheets

SNAP-TOGETHER SHUTTERS WITH MOVEABLE LOUVERS

BACKGROUND OF THE INVENTION

Louvered shutters are known in the prior art for use in ventilating openings in various buildings. In general these shutters are free to move upon changes in pressure between the building interior and the outside air. Other more simple shutters do not include moveable slats or louvers that are responsive to changes in air pressure. Examples of these more simple shutters include the fixed, decorative shutters attached near the windows on many homes. As with any construction materials or components, there is a commercial benefit associated with finding new ways to efficiently store, ship, disassemble, and assemble the components. Efforts to incorporate these efficiency features into louvered shutters are demonstrated in U.S. Pat. Nos. 3,055,467, 4,251,966, 5,673,526, 4,089,257, 5,924,255, and 2,544,182. All of these patents are directed towards shutters with fixed louvers. Such fixed shutters are more easily adapted to forms that allow convenient disassembly, assembly, and efficient space-saving storage for warehousing and shipment.

The '467 patent demonstrates a decorative shutter construction wherein aluminum panels that simulate louver-blades are prefabricated and later cut to fit the desired frame dimensions. The '467 patent does not disclose moveable louvers or a method that provides for the on-site construction of a ventilating, moveable-over shutter system. Similarly, the '966 patent demonstrates decorative shutters of adjustable height using louver panels that have a variable number of slats that can be combined to provide a shutter of the desired height. However, as previously noted, the '966 patent does not disclose moveable louvers or a convenient method for assembling shutters that have moveable louvers. The '526 patent discloses fixed louvers designed for use in frames of various shapes that are intended to serve as vents for gables. The '526 patent does not disclose moveable louvers or a convenient method for disassembling or reassembling shutters containing moveable louvers. The '257 patent merely discloses a rigid system for use as a grill or grating to cover an air duct. This reference includes an easily disassembled apparatus, but the grill or grating does not include moveable louvers. Finally, the '182 and '255 patents disclose adjustable shutters that may be easily constructed, but the louvers in these shutters are fixed in place. The '255 patent includes the feature of snap-together components, and both the '255 and the '182 patents include use of a supporting frame.

As these prior art references demonstrate, there is a need for shutters with moveable louvers that are adapted to be assembled at a construction site or at the point of application. Although the prior art does not disclose easy-to-assemble shutters with moveable louvers, the need for shutter systems adapted to be assembled at the point of application extends to moveable-louver shutters as well as fixed-louver shutters. Therefore, there is a need for shutters that include moveable louvers and that may be easily shipped in a disassembled condition for assembly at the point of application.

SUMMARY OF THE INVENTION

The present invention relates to snap-together shutters wherein moveable louvers may be mounted within a snap-together frame to allow for the convenient assembly of the shutters with or without the use of tools. The shutter includes a frame comprised of frame members that may be joined using corner pieces and T-pieces. For larger shutters, interior center bars may be used in combination with the frame members to support the moveable louvers. A series of pivot rods are mounted within the frame, and louver blades are mounted on the pivot rods. If the user intends to have predetermined groups of louver blades operate in combination, louver arm caps may be mounted on the pivot rods, and tie bars may be used to join the louver arm caps in the desired combinations.

DESCRIPTION OF THE PREFERRED EMBODIMENT OF THE INVENTION

Figure 1:
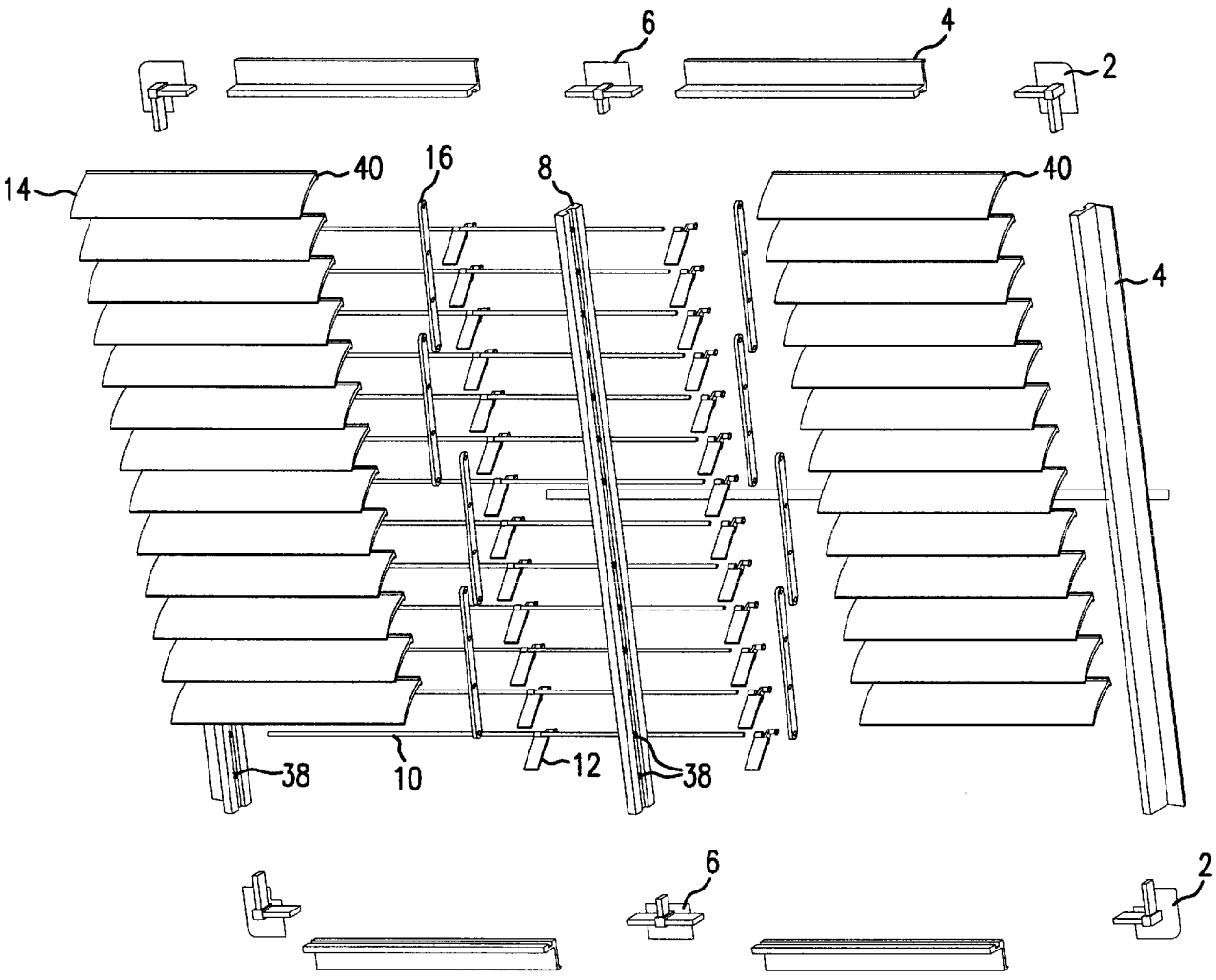
FIG. 1 is an exploded view of an unassembled shutter having moveable louvers.
Figure 4:
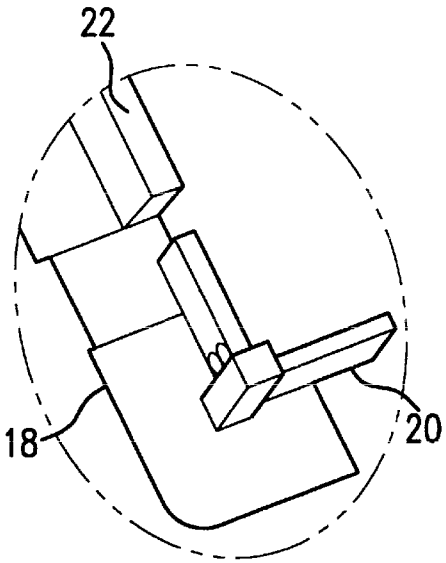
FIG. 4 is a detailed view of a corner piece juxtaposed with a frame member.
Figure 3:
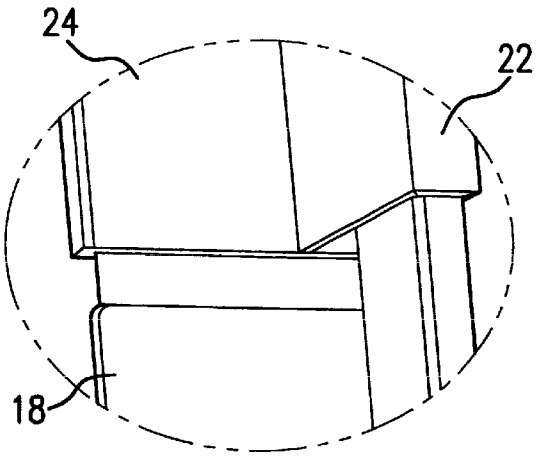
FIG. 3 is detailed view of a corner piece or "T" flange combined with a frame member.
Figure 2:
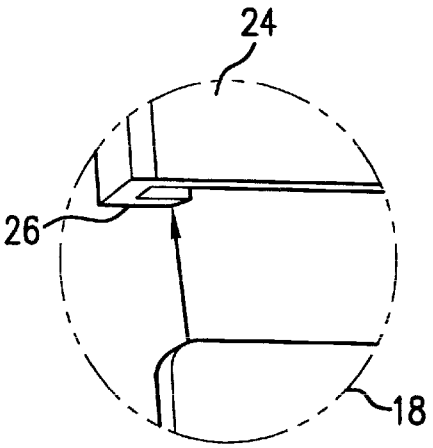
FIG. 2 is a detailed view of a corner piece combined with a frame member.
Figure 6:
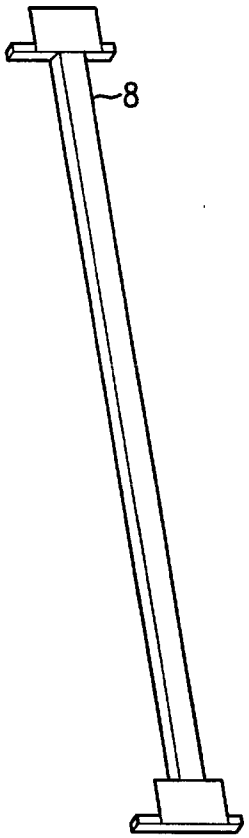
FIG. 6 is a perspective view of a center bar.
Figure 8:
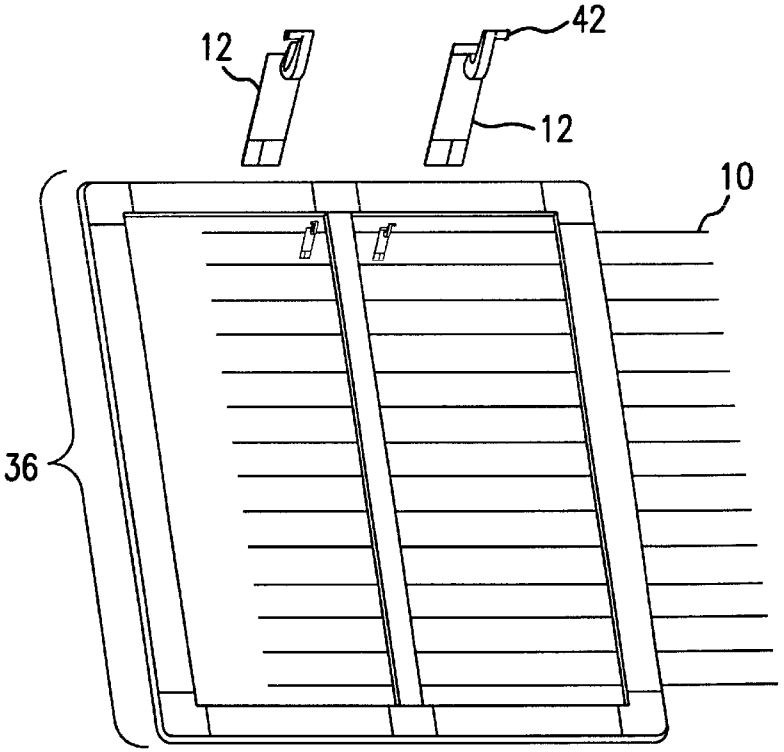
FIG. 8 is view similar to FIG. 7 of an assembled frame with a detailed view of louver arm caps.
Figure 7:
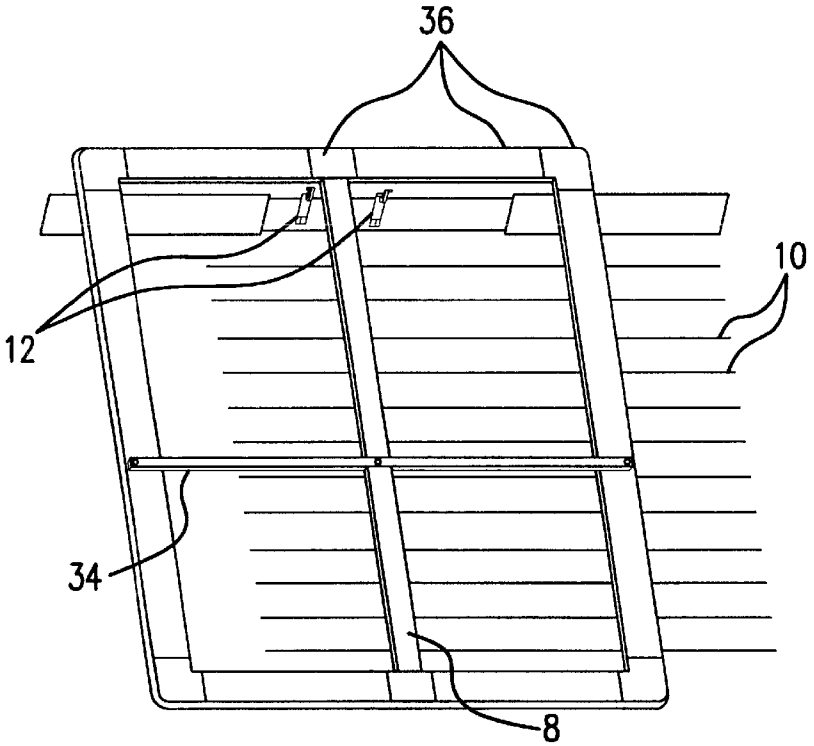
FIG. 7 is a perspective view of an assembled frame and showing the louvers and other components in a position for assembly.
Figure 9:
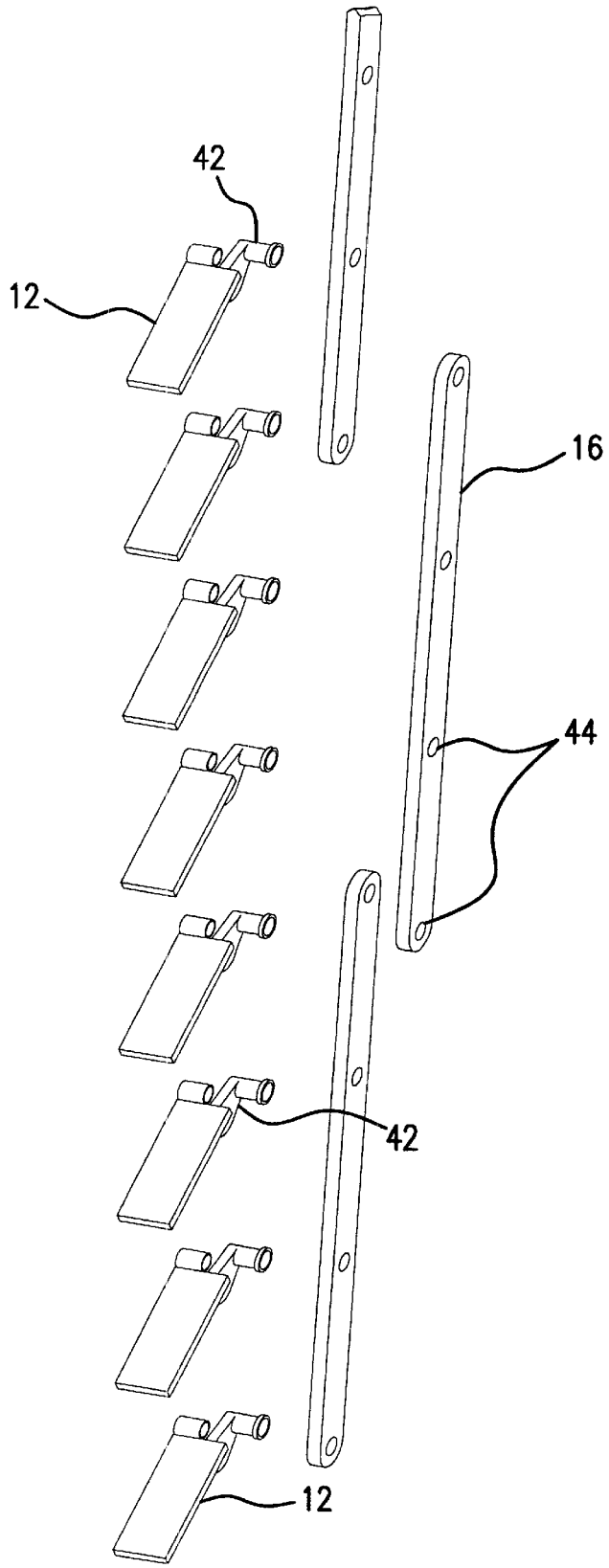
FIG. 9 is an exploded view of louver arm caps juxtaposed with tie bars.

FIG. 1 illustrates an unassembled shutter of the invention with the components and moveable-louvers in position for assembly. As illustrated in FIGS. 7 and 8, when assembled, corner pieces 2, T pieces 6, frame members 4 and center bar 8 comprise the complete frame 36. Corner pieces 2 are used to join frame members 4 while T pieces 6 are used to join frame members 4 to the center bar 8. The center bar 8 and frame members 4 each contain pre-formed holes 38 and the louver blades 14 contain preformed longitudinal openings 40. Pivot rods 10 are inserted through the longitudinal openings 40 and then into the preformed holes 38 and snapped into place. In order to accommodate the insertion of pivot rods 10 after assembly of the frame 36, the pivot rods 10 are made of a flexible or semi-flexible material. Louver arm caps 12 are mounted on the pivot rods 10 such that the louver arm cap pins 42 are mounted in line with one another. If the user of the moveable shutters desires to have selected louver blades 14 move in combination, tie bars 16 may be mounted by inserting the louver arm cap pins 42 joined with the selected louver blades into holes 44 within the tie bars 16.

Figure 5:
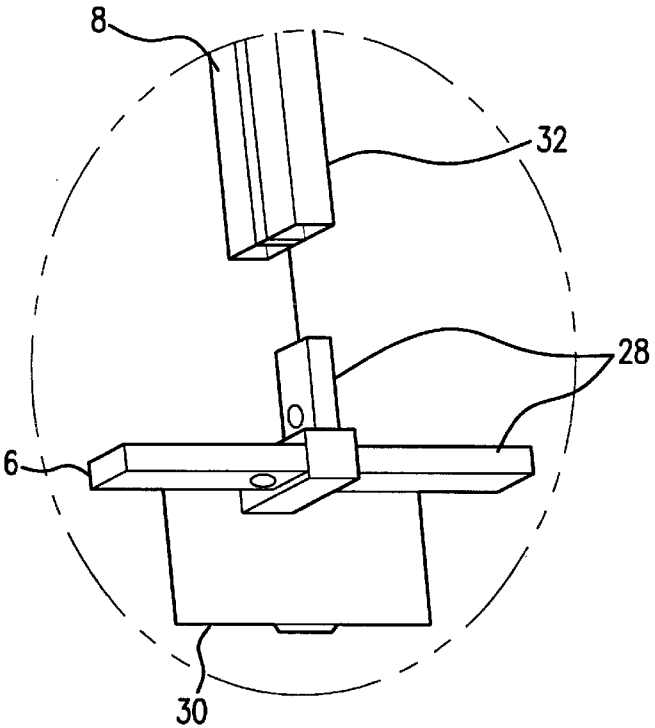
FIG. 5 is a detailed view of a T-piece combined with a center bar.

For ease of assembly, the corner pieces 2 each have a corner piece flange 18 and a corner piece connector 20. The frame members 4 contain connector receivers 22 and flanges 24 each of which has a corner piece flange receiver 26. Similarly, the T-pieces 6 each include a T-piece flange 30 and a T-piece connector 28. The T-piece connectors 28 may be combined with a respective one of the connector receivers 22 on the frame members 4. As illustrated in FIG. 5, T-piece connectors may also be combined with the center bar connector receiver 32. These convenient snap-together pieces allow assembly of a frame that may be used to anchor pivot rods 10.

If the frame 36 is assembled first, it is most convenient to use flexible or semiflexible pivot rods 10 so that the pivot rods 10, after insertion through the louver blades 14, may be inserted through the center bar holes 38 and then snapped into place by inserting the ends of the pivot rods 10 into the frame member holes 38. If a rigid pivot bar 10 is used, then the frame 36 will have to be loosely constructed and snapped firmly into place after the pivot rods 10 have been aligned with the center bar 8 and frame member holes 38. Preferably, especially in larger versions of the shutters, an additional element, namely a strap or frame member stabilizer 34, as shown in FIG. 7, is used to carry a tensile load and reinforce the frame.

When completely assembled, the moveable-louver shutters may be used in ventilating openings for a variety of applications. A common example of such an application is an agricultural building. The louver blades 14 connected to the pivot rods 10 are free to move open upon a change in air pressure. This motion allows intake or exhaust air to pass through the shutters when ventilating fans are turned on. The snap together construction minimizes product storage space and reduces freight costs by allowing storage and transport of the shutters in a disassembled state. In addition, the labor associated with assembly of the shutters is both minimized and transferred to the end user, thus decreasing manufacturing costs. In the most efficient embodiment, assembly of the shutters is convenient and quick as no special tools or adhesives are required. In other embodiments, the methods for connecting components may require the use of tools as dictated by the particular application and desired frame characteristics.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

What is claimed is as follows:

1. A modular, moveable-louver shutter comprising:

a frame having opposing sides and defining an opening therein;

a plurality of flexible pivot rods each having a first end and a second end, said flexible pivot rods being combined with the frame and extending across the opening formed therein;

a plurality of louver blades engaging the flexible pivot rods so that said blades have open and closed positions, said blades being moveable between the open and the closed positions;

at least one T-piece and at least two frame members of said frame combined with the T-piece, wherein:

the T-piece comprises a T-piece flange and a T-piece connector combined with the T-piece flange; and wherein each of the at least two frame members comprises a T-piece connector receiver for slidably engaging the T-piece connector, and a T-piece flange receiver for engaging the T-piece flange.

2. The modular, moveable-louver shutter of claim 1 wherein the frame further comprises: a center bar combined with the T-piece and extending across the opening defined by the frame.

3. A modular, moveable-louver shutter comprising:

a frame having opposing sides and defining an opening formed therein;

a plurality of pivot rods combined with the frame and extending across the opening defined by the frame;

a plurality of moveable louver blades combined with the pivot rods and having open and closed positions, the louver blades being movable between the open and the closed positions; wherein:

the frame comprises at least one T-piece and at least two frame members combined with the T-piece; and wherein:

the T-piece comprises a T-piece flange and more than one T-piece connector combined with the T-piece flange; and each of the at least two frame members comprises a T-piece connector receiver for slidably engaging a respective one of said T-piece connectors, and a T-piece flange receiver for slidably engaging the T-piece flange.

4. The modular, moveable-louver shutter of claim 3 wherein the frame further comprises:

a center bar combined with the T-piece and extending across the opening defined by the frame.

* * * * *